US010267550B2

(12) United States Patent
Ji et al.

(10) Patent No.: US 10,267,550 B2
(45) Date of Patent: Apr. 23, 2019

(54) TRAY FOR ICE MAKING MACHINE, ICE MAKING MACHINE COMPRISING SAME, AND REFRIGERATOR COMPRISING ICE MAKING MACHINE

(71) Applicant: DAE CHANG CO., LTD., Jeollabuk-do (KR)

(72) Inventors: Jun Dong Ji, Gyeonggi-do (KR); Myeong Ji O, Gyeonggi-do (KR); Jong Myung Kim, Gyeonggi-do (KR)

(73) Assignee: DAE CHANG CO., LTD., Jeollabuk-Do (KR)

( * ) Notice: Subject to any disclaimer, the term of this patent is extended or adjusted under 35 U.S.C. 154(b) by 0 days.

(21) Appl. No.: 15/328,412

(22) PCT Filed: Dec. 4, 2014

(86) PCT No.: PCT/KR2014/011858

§ 371 (c)(1),
(2) Date: Jan. 23, 2017

(87) PCT Pub. No.: WO2016/013730

PCT Pub. Date: Jan. 28, 2016

(65) Prior Publication Data

US 2017/0211864 A1 Jul. 27, 2017

(30) Foreign Application Priority Data

Jul. 23, 2014 (KR) ..... 10-2014-0092994
Dec. 4, 2014 (KR) ..... 10-2014-0173395

(51) Int. Cl.
*F25C 1/24* (2018.01)
*F25C 5/08* (2006.01)
(Continued)

(52) U.S. Cl.
CPC ..... *F25C 1/24* (2013.01); *F25C 1/22* (2013.01); *F25C 5/08* (2013.01); *F25C 5/182* (2013.01); *F25C 1/04* (2013.01)

(58) Field of Classification Search
CPC ..... F25C 1/24; F25C 5/182; F25C 5/08
See application file for complete search history.

(56) References Cited

U.S. PATENT DOCUMENTS 1,977,608 A * 10/1934 Blystone ..... F25C 1/24 62/350
2,069,567 A * 2/1937 White ..... F25C 1/24 219/218

(Continued)

FOREIGN PATENT DOCUMENTS

KR 10-2005-0069319 A 7/2005
KR 10-2006-0071644 A 6/2006

(Continued)

OTHER PUBLICATIONS

International Search Report for PCT/KR2014/011858.

*Primary Examiner* — Emmanuel E Duke
(74) *Attorney, Agent, or Firm* — The PL Law Group, PLLC

(57) ABSTRACT

The objective of the present invention is to provide: a tray for an ice making machine which has low heat capacity without requiring surface treatment such as silicon coating and the like; an ice making machine comprising the same; and a refrigerator comprising the ice making machine. The tray for an ice making machine, according to the present invention, which has an inner space capable of accommodating liquid, comprises: a first case which is formed from sheet metal and has a hollow partition for dividing the inner space; and a second case which is formed from resin, wherein the second case is formed by insert injection of the resin into the first case so that the first case and the second case are coupled so as to be superimposed on each other.

12 Claims, 8 Drawing Sheets

(51) Int. Cl.

| | |
|---|---|
| ***F25C 5/182*** | (2018.01) |
| ***F25C 1/22*** | (2018.01) |
| *F25C 1/04* | (2018.01) |

(56) References Cited

U.S. PATENT DOCUMENTS

| | | | | | |
|---|---|---|---|---|---|
| 2,468,492 | A * | 4/1949 | Gazda | F25C 1/24 | 219/201 |
| 3,170,308 | A * | 2/1965 | Cucuzza | F25C 1/24 | 249/52 |
| 3,321,932 | A * | 5/1967 | Orphey, Jr. | F25C 1/24 | 249/111 |
| 3,374,982 | A * | 3/1968 | Sallade | F25C 1/24 | 249/121 |
| 3,775,992 | A * | 12/1973 | Bright | F25C 1/24 | 62/351 |
| 3,952,539 | A * | 4/1976 | Hanson | F25C 1/04 | 62/351 |
| 5,408,844 | A * | 4/1995 | Stokes | F25C 5/08 | 249/79 |
| 5,582,754 | A * | 12/1996 | Smith | F25C 1/24 | 219/386 |
| 2005/0115266 | A1* | 6/2005 | Lim | F25C 5/22 | 62/351 |
| 2007/0170345 | A1 | 7/2007 | Tsujimoto et al. | | |
| 2013/0152617 | A1* | 6/2013 | Oh | F25C 1/24 | 62/351 |

FOREIGN PATENT DOCUMENTS

| | | | |
|---|---|---|---|
| KR | 10-2011-0135124 | A | 12/2011 |
| KR | 10-2012-0082990 | A | 7/2012 |

* cited by examiner

TRAY FOR ICE MAKING MACHINE, ICE MAKING MACHINE COMPRISING SAME, AND REFRIGERATOR COMPRISING ICE MAKING MACHINE

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2014/011858, filed Dec. 4, 2014, which claims priority to the benefit of Korean Patent Application No. 10-2014-0092994 filed in the Korean Intellectual Property Office on Jul. 23, 2014 and Korean Patent Application No. 10-2014-0173395 filed in the Korean Intellectual Property Office on Dec. 4, 2014, the entire contents of which are incorporated herein by reference.

BACKGROUND

[Technical Field]

The present invention relates to a tray for an ice making machine, an ice making machine including the same, and a refrigerator including the ice making machine, and more particularly, to a tray for an ice making machine which includes a first case formed of a sheet metal or resin and a second case formed of resin, an ice making machine including the same, and a refrigerator including the ice making machine.

[Background Art]

Generally, a refrigerator includes a refrigerator compartment configured to refrigerate and store various types of food or beverages and a freezer compartment configured to freeze and store food. Also, the refrigerator may include an ice making machine installed in the freezer compartment or the refrigerator compartment.

The ice making machine receives water and freezes the water by cold air in the refrigerator. The formed ice is discharged to an ice storage case in the refrigerator to be stored therein. The ice making machine includes a tray configured to accommodate water supplied through a fill cup, an ejector configured to discharge ice formed by cold air in the refrigerator from the tray, a motor configured to rotate the ejector, a heater installed at the tray to apply heat to the tray to facilitate the discharge of ice, a controller configured to control the motor and the heater, an ice bank configured to store the ice discharged from the tray by the ejector, an ice discharge guide configured to guide the ice discharged from the tray to the ice bank, and a mounting and engaging part configured to install the ice making machine in the refrigerator using a screw and the like.

However, a tray for a conventional ice making machine is manufactured using a casted thick metal and requires cleaning, anodizing, and surface treatment such as silicone coating of a surface of the metal after casting such that the manufacturing process is long and complicated. Also, because the metal forming the tray is thick, capacity of a heater configured to heat the tray increases such that power consumption is high, and an amount of time for separating ice and making ice increases.

SUMMARY

Consequently, to solve the above problems, an objective of the present invention is to provide a tray for an ice making machine which has low heat capacity without requiring surface treatment such as silicone coating and the like, an ice making machine including the same, and a refrigerator including the ice making machine.

In order to achieve the objective described above, an ice making machine for a refrigerator according to an aspect of the present invention includes a tray having an inner space capable of accommodating a liquid, the tray includes a first case formed of a sheet metal and a second case formed of resin, and the first case and the second case are coupled to be superimposed on each other.

According to another aspect of the present invention, a tray for an ice making machine having an inner space capable of accommodating a liquid includes a first case formed of a sheet metal and having a hollow partition for dividing the inner space and a second case formed of resin, wherein the second case is formed by insert injection of the resin into the first case so that the first case and the second case are coupled to be superimposed on each other.

According to still another aspect of the present invention, a tray for an ice making machine configured to accommodate a liquid includes a body portion formed of a resin material to form an inner space capable of accommodating the liquid and a partition member configured to divide the inner space of the body portion, wherein the body portion is formed by insert injection of the resin into the partition member.

The partition member may be formed of a metal.

The partition member may include a separation plate and a first bent portion formed to intersect one surface of the separation plate.

The partition member may further include a second bent portion formed to intersect the other surface of the separation plate.

The tray for an ice making machine may further include a heater arranged adjacent to a lower surface of the bent portion.

An anchor portion may be formed at the bent portion.

The body portion may cover the partition member and the heater so that the partition member and the heater are adhered to each other.

The body portion may cover the partition member so that the separation plate of the partition member and the other surface at the opposite side of one surface of the bent portion adjacent to the heater are exposed.

The body portion may cover the partition member so that the separation plate of the partition member and the other surface at the opposite side of one surface of the bent portion adjacent to the heater are covered.

A cutout portion may be formed at the separation plate of the partition member.

According to yet another aspect of the present invention, a tray for an ice making machine for accommodating a liquid includes a body portion configured to form an inner space capable of accommodating the liquid and a partition member configured to divide the inner space of the body portion, wherein the partition member includes an insertion portion inserted into an insertion opening formed at the body portion.

The insertion opening may be a through-slit.

The insertion portion may be inserted into the through-slit to protrude by passing through the through-slit.

The insertion opening may be an insertion slit formed by a holding portion of the body portion adjacent to the insertion opening, and the holding portion of the body portion may elastically press the insertion portion inserted by being bent inward or outward of the body portion.

The insertion portion of the partition member may be a bent portion which is bent.

The insertion opening may be a locking slit formed by a support portion and a pressing portion of the body portion adjacent to the insertion opening, the pressing portion may elastically press the bent portion, and the support portion may elastically press the bent portion toward the pressing portion.

The insertion opening may be an insertion hole, and the insertion portion of the partition member may be a protrusion capable of being inserted into the insertion hole.

The tray of an ice making machine may further include a connecting resin mold body formed at a portion adjacent to the insertion opening, and the insertion portion or a portion adjacent to the insertion portion to reinforce connection of the partition member to the body portion.

An anchor portion may be provided at the insertion portion of the partition member or the portion adjacent to the insertion portion.

A groove may be formed at the body portion, the tray for an ice making machine may further include a covering resin mold body configured to cover an inner surface of the body portion, and the covering resin mold body may be formed at the inner surface so that a part of the covering resin mold body is inserted into the groove.

The tray for an ice making machine may further include a heater arranged between the covering resin mold body and the inner surface of the body portion.

The body portion or the partition member may be formed of metal.

According to yet another embodiment of the present invention, a tray for an ice making machine for accommodating a liquid includes a body portion configured to form an inner space capable of accommodating the liquid and a partition member configured to divide the inner space of the body portion, wherein a bent portion is formed at the partition member, and the bent portion is fixedly connected to an inner surface of the body portion.

The tray for an ice making machine may further include a connecting resin mold body formed at the bent portion and a portion of the body portion connected to the bent portion to reinforce connection of the bent portion to the body portion.

According to an embodiment of the present invention, a tray for an ice making machine which has low heat capacity without requiring a surface treatment such as silicone coating and the like, an ice making machine including the same, and a refrigerator including the ice making machine can be provided.

DETAILED DESCRIPTION

Hereinafter, specific embodiments according to the present invention will be described with reference to the accompanying drawings. However, the embodiments described below are merely exemplary embodiments, and the present invention is not limited by the embodiments described below.

In describing the present invention, when a detailed description of a known art related to the present invention is deemed to unnecessarily obscure the gist of the present invention, the detailed description thereof will be omitted. Also, terms that will be described below are terms defined in consideration of functions in the present invention and may vary depending on intentions, practices, or the like of a user or an operator. Thus, the terms should be defined based on contents throughout the present specification.

The technical spirit of the present invention is determined by the appended claims, and the embodiments below are merely means for efficiently describing the technical spirit of the inventive present invention to one of ordinary skill in the art to which the present invention pertains.

Figure 1:
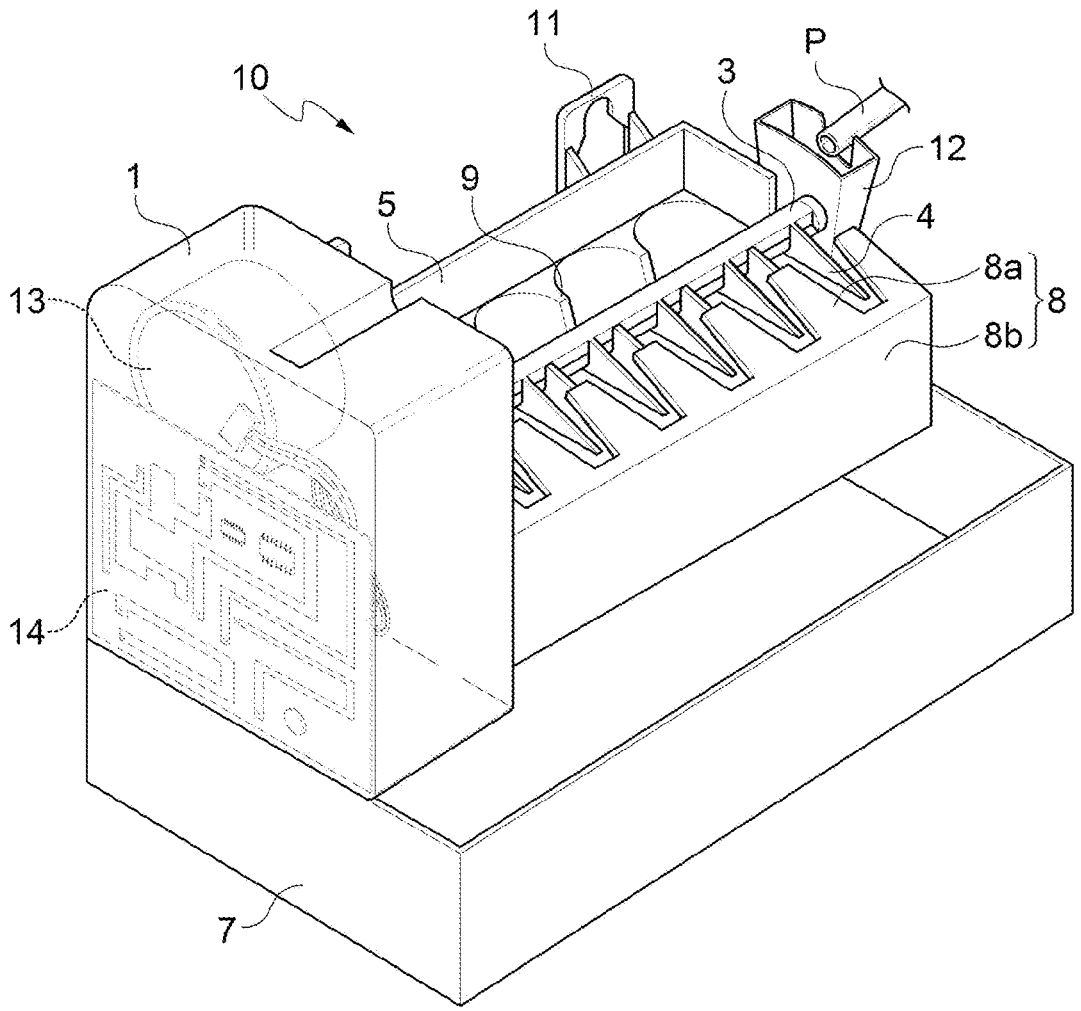
FIG. 1 is a schematic perspective view of an ice making machine according to an embodiment of the present invention.

FIG. 1 is a perspective view of an ice making machine according to an embodiment of the present invention.

As illustrated in FIG. 1, an ice making machine 10 according to an embodiment of the present invention includes a water supply part, e.g., a fill cup 12 configured to receive water supplied to the ice making machine 10, a tray 5 having an inner space capable of accommodating water supplied through the fill cup 12, ejectors 3 and 4 configured to discharge ice formed in the tray 5, a motor 13 configured to rotate an ejector shaft 3, a heater 15 (see FIGS. 2A, 2B and 3) configured to apply heat to the tray 5 to facilitate discharge of ice from the tray 5, an ice bank 7 configured to store ice discharged from the tray 5 by the ejectors 3 and 4, an ice discharge guide 8 configured to guide the ice discharged from the tray 5 to the ice bank 7, a controller 14 configured to control operations of the motor 13 and the heater 15, a control box 1 configured to accommodate the motor 13 and the controller 14, and a mounting and engaging part 11 having a hole through which a screw and the like for installing the ice making machine in a refrigerator (not illustrated) passes.

Water flowing through a pipe P from a water supply source, e.g., a water faucet, outside a refrigerator or a water supply source provided inside a refrigerator, e.g., a refrigerator compartment, is supplied to the fill cup 12. An inner portion of the fill cup 12 is connected to the inner space of the tray 5, and water supplied to the fill cup 12 flows from one end portion of the tray 5, i.e., an end portion to which the fill cup 12 is attached, to the other end portion such that the inner space of the tray 5 divided by a partition 9 is filled with the water up to a predetermined height. The fill cup 12 is manufactured with resin, which is a type of resin that withstands low temperature well. Also, as described below, the fill cup 12 may be formed of the same type of resin as that of a second case 5*b* (see FIGS. 2A, 2B, 3A and 3B) of the tray 5 and, when the second case 5*b* is insert-injected to a first case 5*a*, the fill cup 12 may be integrally injected and formed with the second case 5*b*. Such a manufacturing method simplifies a manufacturing process of the ice making machine 10.

The tray 5 accommodates water supplied from the outside, e.g., water supplied through the fill cup 12, in the inner space. The inner space of the tray 5 is divided by a plurality of partitions 9 that intersect a longitudinal direction of the tray 5. Each of the divided inner spaces of the tray 5 corresponds to an ejector pin 4. Cold air in the refrigerator is provided to the tray 5, and water filled in the inner space of the tray 5 is frozen into ice. The heater 15 configured to apply heat to the tray when ice is separated therefrom is provided to the tray 5. The fill cup 12 is formed at one end portion of the tray 5, and the control box 1 is formed at the other end portion thereof. Also, the mounting and engaging part 11 through which an engaging member, e.g., a screw, passes when the ice making machine 10 is installed in the refrigerator is formed at a wall portion parallel to the longitudinal direction of the tray 5. The ice discharge guide 8 configured to guide ice to the ice bank 7 when ice is separated from the tray 5 is formed at a wall portion facing the wall portion at which the mounting and engaging part 11 is formed.

The ejectors 3 and 4 configured to push ice formed in the tray 5 from the tray 5 are provided at an upper side of the tray 5. The ejectors 3 and 4 include the ejector shaft 3 installed parallel to the longitudinal direction of the tray 5 between the control box 1 and the fill cup 12 and configured to receive a driving force of the motor 13 in the control box 1; and a plurality of ejector pins 4 configured to extend in a direction orthogonal to the ejector shaft 3 and provided at positions corresponding to the divided inner spaces of the tray 5. When the water in the inner space of the tray 5 is frozen into ice, a driving force of the motor 13 operated by the controller 14 is properly decelerated by a chain of gears and transmitted to the ejector shaft 3, the ejector shaft 3 rotates and the plurality of ejector pins 4 formed at the ejector shaft 3 also rotates together as a result, such that ice formed in the tray 5 is pressed and pushed out from the tray 5 toward an upper surface of the ice discharge guide 8.

The control box 1 is formed at an end portion of the tray 5 facing one end portion of the tray 5 at which the fill cup 12 is formed. A hole through which the ejector shaft 3 passes and a hole through which a connection part of the heater 15 passes to be electrically connected to the controller 14 are formed at one surface of the control box 1 facing the tray 5, and detachable caps thereof are formed at the other surface thereof such that the caps may be removed to assemble the motor 13 and the controller 14 in the control box 1 and may be closed when the assembling is finished. The control box 1 may be formed of the same type of resin as that of the second case of the tray 5 and, when the second case of the tray 5 is insert-injected to the first case, may be integrally injected with the second case. Such a method of manufacturing the ice making machine simplifies a manufacturing process of the ice making machine 10.

The mounting and engaging part 11 formed at the wall portion of the tray 5 parallel to the longitudinal direction of the tray 5 protrudes more upward than the tray 5 and may facilitate a task of installing the ice making machine 10 in a refrigerator. Although the illustrated configuration of the mounting and engaging part 11 has a hole through which a screw passes, the mounting and engaging part 11 may also have other configurations, such as a hook capable of being hung on an inner wall of a refrigerator. The mounting and engaging part 11 may be formed of the same type of resin as that of the second case 5*b* of the tray 5 and, when the second case 5*b* is insert-injected to the first case 5*a*, may be integrally injected with the second case 5*b*. Such a method of manufacturing the ice making machine simplifies a manufacturing process of the ice making machine 10.

The ice discharge guide 8 is formed at a side portion facing the wall portion of the tray 5 at which the engaging part 11 is formed. The ice discharge guide 8 is formed of an upper guide 8*a* having groove portions corresponding to the ejector pins 4 so that the ejector pins 4 are respectively arranged therein and a lower guide 8*b* arranged below the upper guide 8*a* to be inclined more downward than the upper guide 8*a* and formed at a side portion of the tray 5. The lower guide 8*b* is formed with the same type of resin as that of the second case 5*b* of the tray 5 and, when the second case 5*b* is insert-injected to the first case 5*a*, may be integrally injected with the second case 5*b*. Such a method of manufacturing the ice making machine may simplify a manufacturing process of the ice making machine 10. The upper guide 8*a* may be, for example, separately injected and fitted to a groove portion formed at the tray 5 or the lower guide 8*b*.

The ice bank 7 configured to store ice discharged from the tray 5 by the ejectors 3 and 4 is provided at a lower side of the tray 5. A through-hole that allows stored ice to be moved to another place, e.g., an ice dispenser provided at a refrigerator door, or a moving mechanism (not illustrated) configured to facilitate a flow of ice may be provided in the ice bank 7.

Hereinafter, a configuration of the tray 5 will be described in more detail with reference to FIGS. 2A, 2B, 3A and 3B.

Figure 2A:
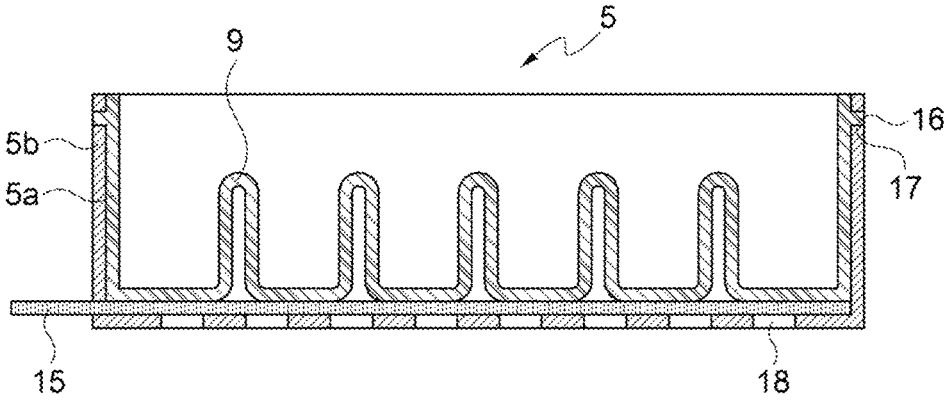
FIGS. 2A and 2B are a lateral cross-sectional view and a plan view, respectively, of a tray according to an embodiment of the present invention.
Figure 2B:
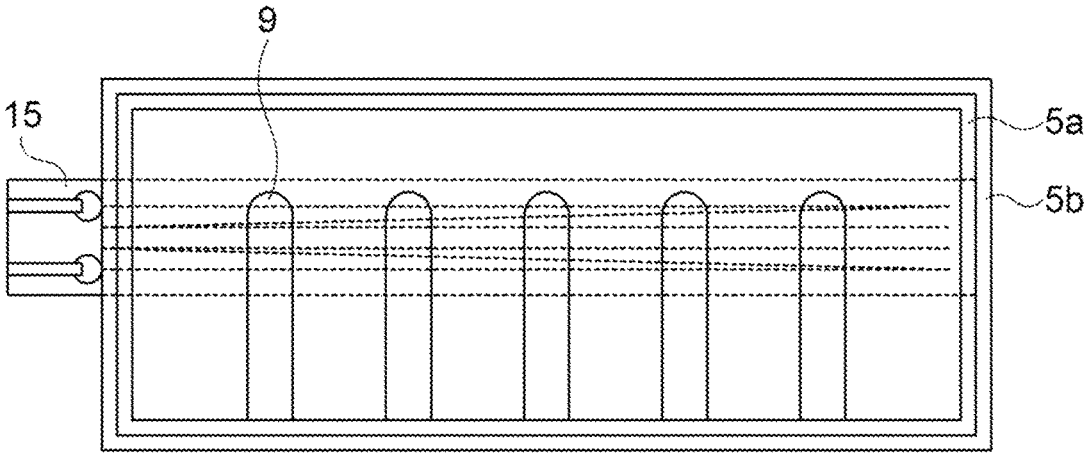

FIGS. 2A and 2B show a schematic vertical cross-sectional view in the longitudinal direction (FIG. 2A) and a plan view (FIG. 2B) of a configuration of the tray 5 according to an embodiment of the present invention.

As illustrated in FIGS. 2A and 2B, the tray 5 includes the first case 5*a* formed of a sheet metal, the second case 5*b* formed of resin, and the heater 15 provided between the first case 5*a* and the second case 5*b*. The first case 5*a* of the tray 5 is coupled to the second case 5*b* to be superimposed on an inner portion of the second case 5*b*. Such a configuration is possible by, for example, the second case 5*b* being formed by insert injection of the resin into the first case 5*a*.

The first case 5*a* of the tray 5 is formed, for example, by pressing (drawing) a sheet metal having a thickness of 0.5 mm or smaller or by aluminum die casting. The first case 5*a* has a semi-circular cross-section and a vertical wall formed at both end portions thereof. An inner space of the first case 5*a* is divided by the plurality of partitions 9. The divided spaces respectively correspond to the plurality of ejector pins 4. As illustrated in FIG. 2A, the partitions 9 are formed to be hollow. Hollow spaces of the partitions 9 may communicate with the outside of the tray 5 through cutout portions 18 formed at the second case 5*b*. The communication may enable cold air to be transmitted better to water accommodated in the tray 5 through the first case 5*a* and may shorten an amount of time taken for ice formation.

A protrusion 16 is formed at an outer surface, e.g., an outer surface of a vertical wall, of the first case 5*a* and is inserted into a groove in the second case 5*b* corresponding thereto. Alternatively, a groove 17 and the protrusion 16 may be conversely formed, or the groove 17 and the protrusion 16 may be formed at both of the cases 5*a* and 5*b*. The protrusion may have various shapes such as a cylindrical shape, a rectangular cylindrical shape, and a hook shape, and the groove corresponding thereto may also have various shapes. By such a configuration, a coupling force between the first case 5*a* and the second case 5*b* is improved, and the second case 5*b* is prevented from being separated from the second case.

Also, alternatively or additionally, a concave-convex portion may be formed at the outer surface of the first case 5*a*. The concave-convex portion may increase the coupling force between the first case 5*a* and the second case 5*b* and more effectively prevent the second case 5*b* from being separated from the first case 5*a*. The concave-convex portion on the outer surface of the first case 5*a* may be formed by, for example, an embossing treatment or a spraying treatment.

The second case 5*b* of the tray 5 is coupled to the first case 5*a* to surround the outer surface of the first case 5*a*, i.e., so that the first case 5*a* is superimposed on an inner portion of the second case 5*b*. In such coupling, the second case 5*b* may be formed by insert-injection to the first case 5*a*. By such coupling, structural stiffness of the tray 5 may be maintained by the second case 5*b* even when the first case 5*a* is formed of a sheet metal. Here, the injection may be performed while the heater 15 that will be arranged between the first case 5*a* and the second case 5*b* is preliminarily adhered to the outer surface of the first case 5*a* by an adhesive sheet. The groove 17 corresponding to the protrusion 16 formed at the outer surface of the first case 5*a* is naturally provided by forming the second case 5*b* by insert-injection to the first case 5*a*. Also, a plurality of cutout portions 18 configured to expose the outer surface of the first case 5*a*, e.g., an outer surface of a bottom portion thereof, are formed at the second case 5*b*. The cutout portions 18 expose the outer surface, particularly, the bottom portion, of the first case 5*a*, and shapes or positions of the cutout portions 18 may be selected from various shapes or positions. However, the cutout portions 18 may be arranged so that a portion requiring more cold air in the tray 5, e.g., an outer surface of a bottom portion adjacent to both end portions of the tray 5, is exposed more. Also, some of the cutout portions 18 communicate the outside of the tray 5 with the hollow spaces of the partitions 9 so that cold air is introduced into the hollow spaces of the partitions 9. By such a configuration, cold air may be more effectively transmitted to water accommodated in the tray 5, and an amount of time taken for ice formation may be shortened.

The heater 15 arranged between the first case 5*a* and the second case 5*b* is inserted by forming the second case 5*b* by insert-injection to the outer surface of the first case 5*a*, i.e., by insert-injection of the resin forming the second case 5*b* to the outer surface of the first case 5*a*. The heater 15 includes a connection part electrically connected to the controller 14, and the connection part protrudes to the outside of the first case 5*a* and the second case 5*b*. The heater 15 may be arranged at an area different from an area of the second case 5*b* in which the cutout portions 18 are formed and may not be exposed through the cutout portions 18. The heater 15 may be, for example, a plane heater or a cord heater, a heating element of the heater 15 may be a sheet metal, and the sheet metal may be covered by an outer skin formed of a polyimide material.

Also, a surface area of the heating element of the heater 15 formed of the sheet metal may be 30% of a surface area of the tray 5 or smaller, thereby enabling cold air in the refrigerator to be transmitted well when ice is manufactured by the ice making machine 10. In this case, the cutout portions 18 may expose a surface of the heater 15.

Figure 3A:
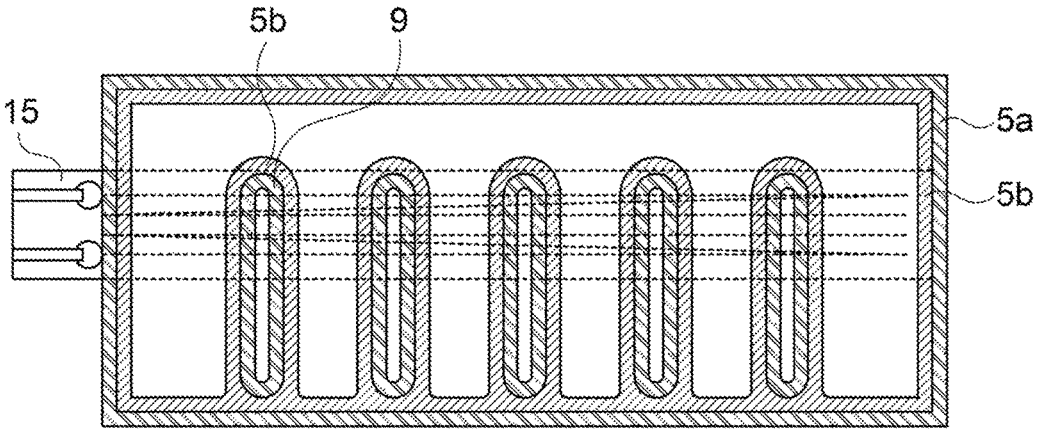
FIGS. 3A and 3B are a lateral cross-sectional view and a plan view, respectively, of a tray according to an embodiment of the present invention.
Figure 3B:
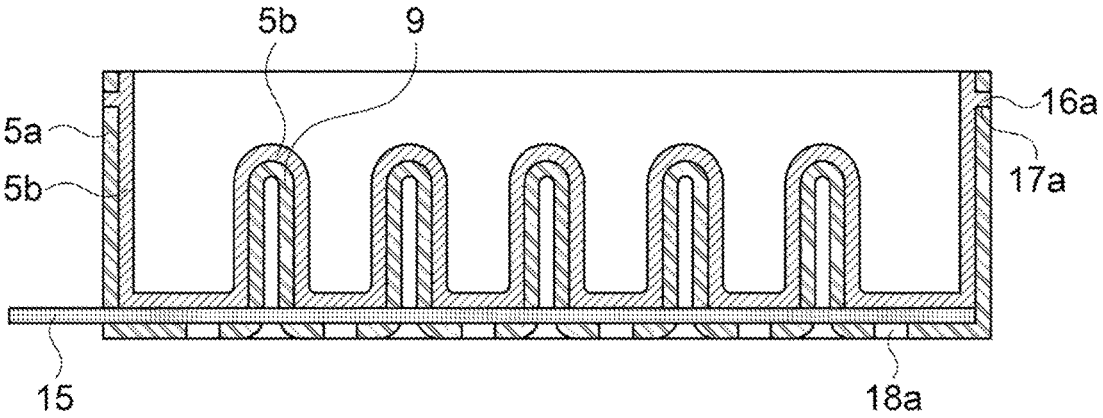

FIGS. 3A and 3B show a planar cross-sectional view (FIG. 3A) and a vertical cross-sectional view in the longitudinal direction (FIG. 3B) of a tray for an ice making machine according to another embodiment of the present invention.

As illustrated in FIGS. 3A and 3B, a tray 5 according to another embodiment of the present invention includes a first case 5*a* formed of a sheet metal, a second case 5*b* coupled to be superimposed on the inner portion of the first case 5*a* and formed of resin, and the heater 15 arranged between the first case 5*a* and the second case 5*b*.

The first case 5*a* of the tray 5 is formed, for example, by pressing a sheet metal having a thickness of 0.5 mm or smaller or by aluminum die casting. Like the first case illustrated in FIGS. 2A and 2B, the first case 5*a* has a semi-circular cross-section and a vertical wall formed at both end portions thereof. An inner space of the first case 5*a* is divided by the plurality of partitions 9. The divided spaces respectively correspond to the plurality of ejector pins 4. As illustrated in FIGS. 3A and 3B, the partitions 9 are formed to be hollow. Hollow spaces of the partitions 9 may communicate with the outside of the tray 5, and the communication may enable cold air to be transmitted better to water accommodated in the tray 5 through the first case 5*a* and may shorten an amount of time taken for ice formation. Also, a through-hole through which the heater 15 arranged at an inner surface of a bottom portion of the first case 5*a* passes is provided at the partitions 9. A through-hole through which the heater 15 may pass is also provided at a vertical wall of the first case 5*a* adjacent to the control box 1.

A groove 17*a* is formed at an outer surface of the first case 5*a*, e.g., an outer surface of the vertical wall formed at the both end portions of the first case 5*a*, and a protrusion 16*a* corresponding thereto in the second case 5*b* is inserted thereinto. Alternatively, the groove 17*a* and the protrusion 16*a* may be conversely formed, or the groove 17*a* and the protrusion 16*a* may be formed at both of the cases 5*a* and 5*b*. By such a configuration, a coupling force between the first case 5*a* and the second case 5*b* is improved, and the second case 5*b* is prevented from being separated from the second case.

Also, alternatively or additionally, a concave-convex portion may be formed at an inner surface of the first case 5*a*. The concave-convex portion may increase the coupling force between the first case 5*a* and the second case 5*b* and more effectively prevent the second case 5*b* from being separated from the first case 5*a*. The concave-convex portion on the inner surface of the first case 5*a* may be formed by, for example, an embossing treatment or a spraying treatment.

The second case 5*b* of the tray 5 may be coupled to the first case 5*a* to be superimposed on an inner portion of the first case 5*a*. Such coupling may be achieved, for example, by forming the second case 5*b* by insert-injection to the inner surface of the first case 5*a*. By such coupling, structural stiffness of the tray 5 may be maintained by the second case 5*b* even when the first case 5*a* is formed of a sheet metal. Here, the injection may be performed while the heater 15 that will be arranged between the first case 5*a* and the second case 5*b* is preliminarily adhered to the inner surface of the first case 5*a* by an adhesive sheet. The protrusion 16*a* corresponding to the groove 17*a* formed at the inner surface of the first case 5*a* is naturally provided by forming the second case 5*b* by insert-injection to the first case 5*a*. Also, a plurality of cutout portions 18*a* configured to expose an outer surface of the second case 5*b*, e.g., an outer surface of a bottom portion thereof, are formed at the first case 5*a*. The cutout portions 18*a* expose the outer surface, particularly, the bottom portion, of the second case 5*b*, and shapes or positions of the cutout portions 18*a* may be selected from various shapes or positions. However, the cutout portions 18*a* may be arranged so that a portion requiring more cold air in the tray 5, e.g., an outer surface of a bottom portion adjacent to both end portions of the tray 5, is exposed more. By such a configuration, cold air may be more effectively transmitted to water accommodated in the tray 5, and an amount of time taken for ice formation may be shortened.

Also, the second case 5*b* may completely cover surfaces of the partitions 9 in the first case 5*a*, i.e., surfaces forming the inner space of the tray 5. By such configuration, burr formation may be prevented when the second case 5*b* is formed by insert-injection to the first case 5*a*.

The heater 15 arranged between the first case 5*a* and the second case 5*b* is inserted by performing insert-injection of the resin forming the second case 5*b* to the inner surface of the first case 5*a*. The heater 15 includes a connection part electrically connected to the controller 14, and the connection part protrudes to the outside of the first case 5*a* and the second case 5*b*. The heater 15 may be arranged at an area different from an area of the second case 5*b* in which the cutout portions 18*a* are formed and may not be exposed through the cutout portions 18*a*. The heater 15 may be, for example, a plane heater or a cord heater, a heating element of the heater 15 may be a sheet metal, and the sheet metal may be covered by an outer skin formed of a polyimide material.

Also, an area of the heating element of the heater 15 formed of the sheet metal may be 30% of a surface area of the tray 5 or smaller, thereby enabling cold air in the refrigerator to be transmitted well when ice is manufactured by the ice making machine 10. In this case, the cutout portions 18*a* may expose a surface of the heater 15.

In the ice making machine 10 including a tray for an ice making machine having the configuration described above, the first case 5*a* is formed of a sheet metal, and the second case formed of resin is coupled to the first case to be superimposed on the first case. Thus, a manufacturing process of the ice making machine is simple, and cold air in a refrigerator may be rapidly transmitted to water in the tray, thereby shortening an amount of time taken for ice formation.

Although the first case is formed of a sheet metal in the embodiment described above, the first case may also be formed of the same type or a different type of resin as or from the resin forming the second case. In this case, a method of forming a first case is different from a method of forming the first case according to the embodiment described above, but the remaining configurations may be the same as in the embodiment described above.

The ice making machine 10 according to an embodiment of the present invention is mounted inside a refrigerator, e.g., a freezer compartment. Here, the ice making machine 10 may be fixed to a door or an inner wall of the freezer compartment by a screw passing through the mounting and engaging part 11. Also, the controller 14 may be connected to a controller or a power supply of the refrigerator.

Figure 4A:
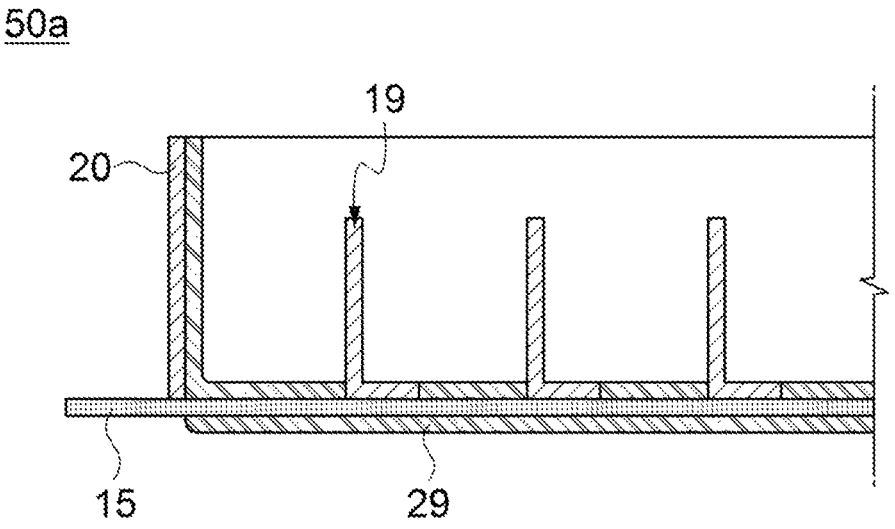
FIGS. 4A and 4B are lateral cross-sectional views of a tray according to another embodiment of the present invention.
Figure 4B:
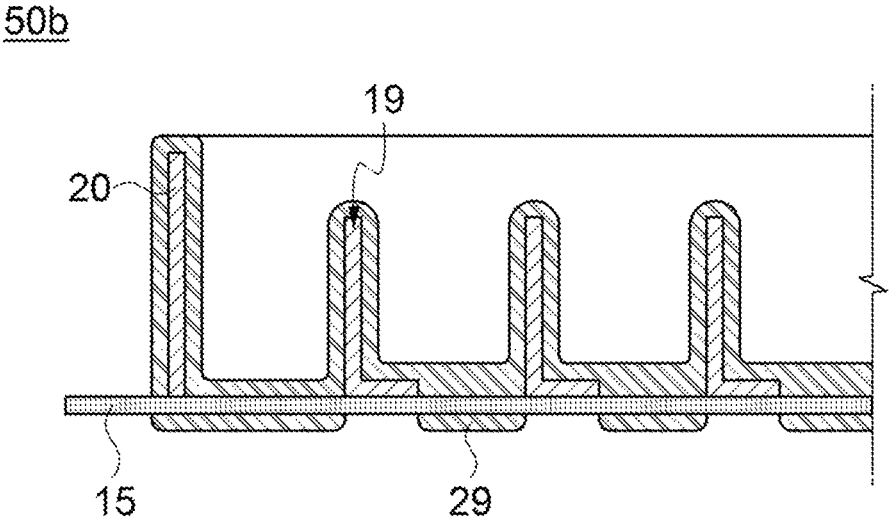

Referring to FIGS. 4A and 4B, schematic cross-sectional views of parts of trays 50*a* and 50*b* for an ice making machine according to another embodiment of the present invention in the longitudinal direction are respectively illustrated. The trays 50*a* and 50*b* for an ice making machine are arranged to be spaced a predetermined distance from each other and include a plurality of partition members 19 configured to divide inner spaces of the trays 50*a* and 50*b*, a vertical wall member 20, and a body portion 29 formed of resin to form an inner space for accommodating a liquid.

Figure 5A:
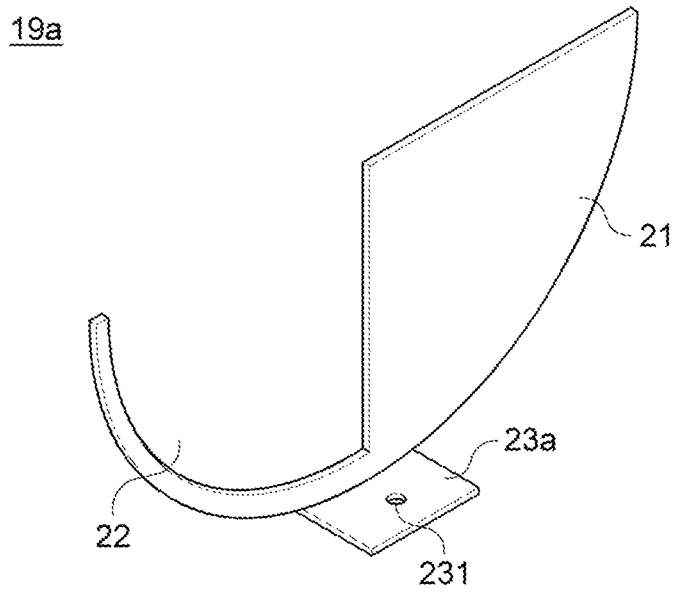
FIGS. 5A and 5B are perspective views of partition members 19*a* and 19*b*, respectively, according to a modified embodiment of the present invention.
Figure 5B:
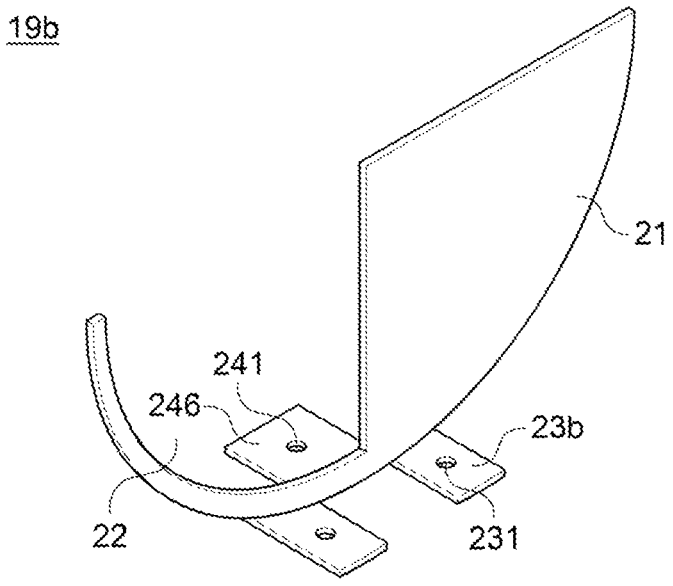

The partition members 19 may be formed, for example, of metal having high heat conductivity to have an L-shaped cross-section, and bottom portions of the partition members 19 are connected to the body portion 29. More specifically, the partition members will be described with reference to FIGS. 5A and 5B. FIGS. 5A and 5B respectively illustrate perspective views of partition members 19*a* and 19*b* according to a modified embodiment of the present invention.

As illustrated in FIG. 5A, the partition member 19*a* may include a separation plate 21 and a bent portion 23*a* formed to intersect a lower portion of one surface of the separation plate 21. Also, a cutout portion 22 may be formed at the separation plate 21.

A liquid supplied to the tray 50*a* through the cutout portion 22 may pass through the partition member 19*a* to flow. An anchor portion 231 may be formed at the bent portion 23*a*. The anchor portion 231 is a means for reinforcing a connection between the partition member 19*a* and the body portion 29 and may be any one of a hole, a protrusion, or a rough surface. In the modified embodiment, the anchor portion 231 is a hole 231.

Alternatively, as illustrated in FIG. 5B, the partition member 19*b* may include two first bent portions 23*b* formed to intersect a lower portion of one surface of the separation plate 21 at which the cutout portion 22 may be formed, and a second bent portion 24*b* formed to intersect a lower portion of the other surface of the separation plate 21. The two first bent portions 23*b* may be spaced apart from each other, and the second bent portion 24*b* may be connected to a portion of the other surface corresponding to a gap between the two first bent portions 23*b*. Holes 231 and 241 may be respectively formed at the first bent portions 23*b* and the second bent portion 24*b* as the anchor portions 231 and 241.

The body portion 29 is formed by insert-injection to the plurality partition members 19, 19*a*, and 19*b* spaced apart from one another and the vertical wall member 20. The body portion 29 may be insert-injected to expose bottom portions of the partition members 19, 19*a*, and 19*b* or upper surfaces of the bent portions 23*a*, 23*b*, and 24*b* (see FIG. 4A) or may be insert-injected to completely cover the partition members 19, 19*a*, and 19*b* (see FIG. 4B). Here, the body portion 29 may be insert-injected to expose a lower surface of the heater 15 arranged between lower surfaces of the partition members 19, 19*a*, and 19*b* and the body portion 29 (see FIG. 4B).

Referring to FIGS. 6A to 6E, cross-sectional views and cross-sectional perspective views of a part of a tray for an ice making machine according to another embodiment of the present invention are illustrated. Hereinafter, in describing the present embodiment, differences from the embodiments described above will be mainly described for conciseness.

Figure 6A:
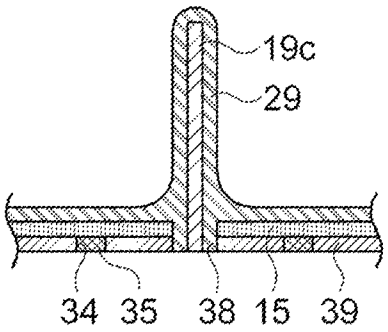
FIGS. 6A and 6E, and FIGS. 6B, 6C and 6D are cross-sectional views and cross-sectional perspective views, respectively, of a part of a tray for an ice making machine according to another embodiment of the present invention.
Figure 8A:
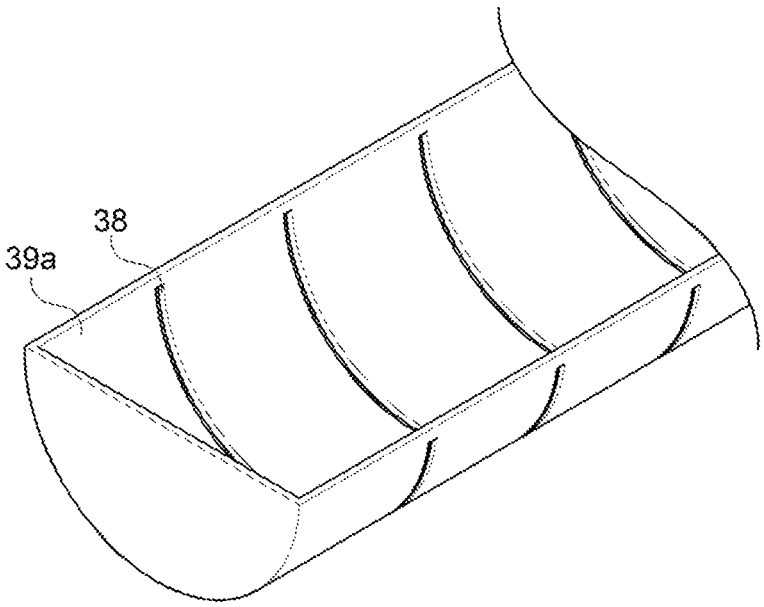
FIGS. 8A and 8B are perspective views of a part of a tray for an ice making machine according to yet another embodiment of the present invention.

As illustrated in FIG. 6A, a tray for an ice making machine includes a partition member 19*c* and a body portion 39 having a through-slit 38 as illustrated in FIG. 8A formed as an insertion opening for insertion of the partition member 19*c*. Also, surfaces of the partition member 19*c* and the body portion 39 may be covered by a covering resin mold body 29 formed by insert-injection to the partition member 19*c* and the body portion 39. The heater 15 may be arranged between an upper surface of the body portion 39 and the covering resin mold body 29, and a hole (not illustrated) through which the heater 15 may pass may be formed at the partition member 19*c*.

The partition member 19*c* is formed, for example, of metal having high heat conductivity and has a flat plate shape. A lower end portion of the partition member 19*c* may be inserted into the through-slit 38 formed at the body portion 39 and may be fixedly connected to the body portion 39. Also, a plurality of partition members 19*c* are arranged in the body portion 39 to be spaced a predetermined distance from one another to divide an inner space for accommodating a liquid formed by the body portion 39.

The body portion 39 may be formed, for example, of metal having high heat conductivity and may form a space in which a liquid is accommodated. An anchor portion 34, e.g., a groove 34, may be formed at the body portion 39, and a protrusion 35 inserted into the groove 34 may be formed at the covering resin mold body 29. The groove 34 and the protrusion 35 reinforce coupling between the body portion 39 and the covering resin mold body 29 configured to cover the upper surface of the body portion 39.

Figure 8B:
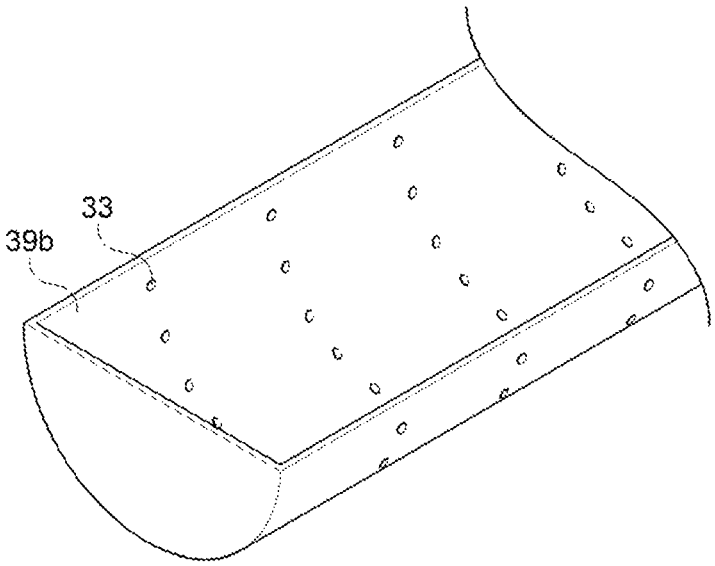

Also, instead of the through-slit 38, an insertion hole 33 as illustrated in FIG. 8B may be formed at the body portion 39. In this case, a protrusion (not illustrated) that may be inserted into the insertion hole 33 may be formed at a lower end of the partition member 19*c*.

The covering resin mold body 29 may be formed by, for example, using resin having high heat conductivity and insert-injection to the partition member 19*c* and the body portion 39. The covering resin mold body 29 may further reinforce the coupling between the partition member 19*c* and the body portion 39 and prevent leakage of liquid through the through-slit 38, the insertion hole 33, and the groove 34.

Figure 6B:
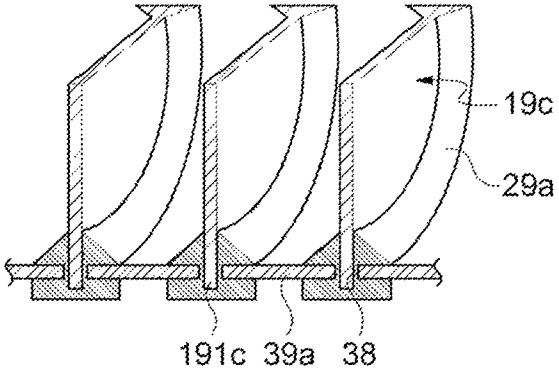

As illustrated in FIG. 6B, an insertion portion 191*c*, which is a lower end portion of the partition member 19*c*, may be inserted into the through-slit 38 to protrude by passing through the through-slit 38, which is an insertion opening of a body portion 39*a*. By such a configuration, cold air outside the tray for an ice making machine may be more effectively transmitted to a liquid in the tray through the protruding insertion portion 191*c* and the partition member 19*c*.

Also, instead of the covering resin mold body 29 illustrated in FIG. 6A, a connecting resin mold body 29*a* may be formed to cover a connection portion between the partition member 19*c* and the body portion 39*a*. The connecting resin mold body 29*a* may reinforce connection between the partition member 19*c* and the body portion 39*a* and prevent a liquid in the tray for an ice making machine from leaking through the through-slit 38 of the body portion 39*a*.

Figure 6C:
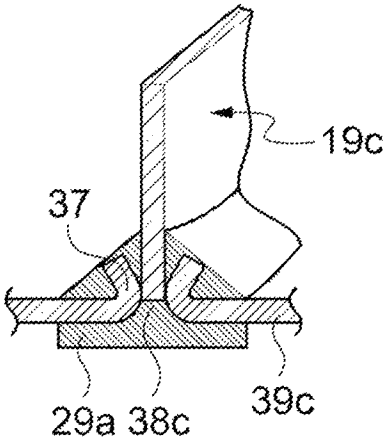

Also, as illustrated in FIG. 6C, an insertion slit 38*c*, which is an insertion opening formed at a body portion 39*c* for the partition member 19*c* to be inserted thereinto, may be formed between holding portions 37 curved inward from the tray for an ice making machine. The holding portions 37 may be configured to elastically press the lower end portion of the partition member 19*c* from both surfaces thereof. Opposite from what is illustrated in FIG. 6C, the holding portions 37 may be curved outward from the tray.

Figure 6D:
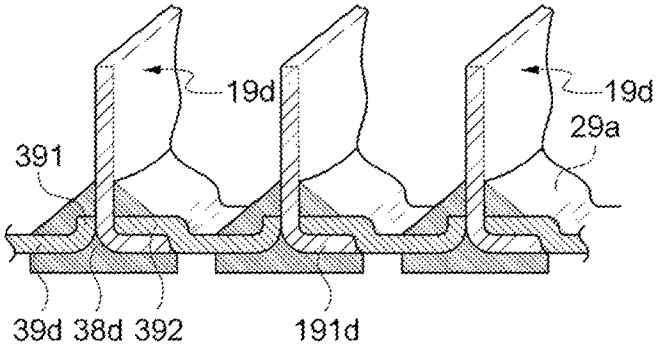

Also, as illustrated in FIG. 6D, a partition member 19*d* and a body portion 39*d* may be connected to each other by a bent portion 191*d*, which is an insertion portion inserted into the body portion 39*d* and is bent, formed at a lower end portion of the partition member 19*d* and inserted into a locking slit 38*d*, which is an insertion opening formed at the body portion 39*d*. The locking slit 38*d* may include a pressing portion 392 configured to elastically press an upper surface of the bent portion 191*d* of the partition member 19*d* and a support portion 391 configured to elastically press the partition member 19*d* toward the pressing portion 392.

Figure 6E:
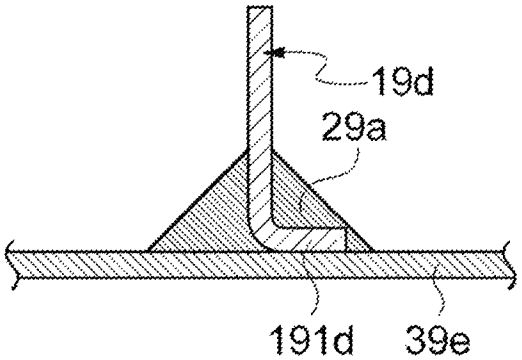

Also, as illustrated in FIG. 6E, the bent portion 191*d* may be formed at the lower end portion of the partition member 19*d*, and the bent portion 191*d* may be connected to a body portion 39*e* by, for example, welding and the like. The bent portion 191*d* may have a portion bent toward one side as well as the other side. The connecting resin mold body 29*a* may be formed at a portion at which the bent portion 191*d* and the body portion 39*e* are connected to each other.

Figure 7:
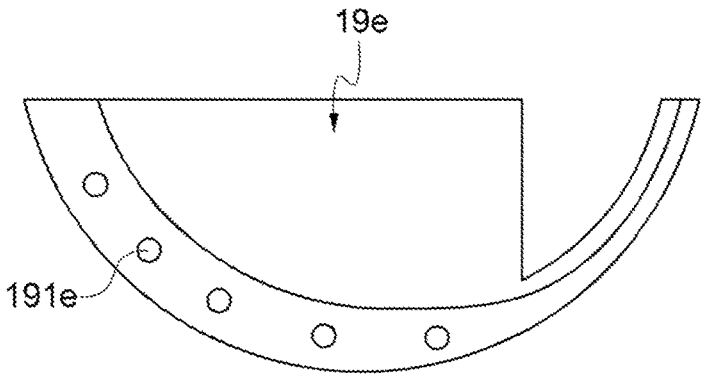
FIG. 7 is a perspective view of a partition member according to still another embodiment of the present invention.

Referring to FIG. 7, a perspective view of a partition member according to still another embodiment of the present invention is illustrated. A difference of a partition member 19*e* illustrated in FIG. 7 from the partition members 19, 19*a*, 19*b*, 19*c*, and 19*d* described above is that an anchor portion 191*e*, e.g., a groove 191*e*, is formed at a lower end portion of the partition member 19*e*. The anchor portion 191*e* may reinforce coupling between the covering resin mold body 29 or the connecting resin mold body 29*a* and the partition member 19*e*. Also, the anchor portion 191*e* may also be applied to the partition members 19, 19*a*, 19*b*, 19*c*, and 19*d* described above.

Although the present invention has been described in detail above by describing the representative embodiments thereof, one of ordinary skill in the art to which the present invention pertains should understand that the embodiments described above may be modified in various ways within the limit not departing from the scope of the present invention. Thus, the scope of the present invention should not be defined by being limited to the embodiments described above but should be defined by the appended claims as well as those equivalent to the claims.

The invention claimed is:

1. An ice making machine comprising a tray having an inner space capable of accommodating a liquid and making ice, wherein:

the tray includes a first case formed of a sheet metal and a second case formed of resin;

the first case and the second case are coupled to be superimposed on each other;

a heater is arranged between the first case and the second case;

one of the first case and the second case is formed at an inner surface of the tray, and the other of the first case and the second case is formed at an outer surface of the tray; and a cutout portion is formed at the other of the first case and the second case, and the cutout portion exposes at least a portion of an outer surface of a bottom portion of said one of the first case and the second case.

2. The ice making machine of claim 1, wherein the heater is a plane heater or a cord heater.

3. The ice making machine of claim 2, wherein a heating element of the heater is a sheet metal.

4. The ice making machine of claim 3, wherein an outer skin of the heating element is formed of polyimide.

5. The ice making machine of claim 1, wherein the first case is coupled to be superimposed on an inner portion of the second case.

6. The ice making machine of claim 5, wherein the second case is integrated with at least one of a control box, an ice discharge guide, a fill cup, and a mounting support of the ice making machine.

7. The ice making machine of claim 1, wherein the second case is coupled to be superimposed on an inner portion of the first case.

8. The ice making machine of claim 7, wherein the second case covers a surface of a partition in the first case dividing the inner space.

9. The ice making machine of claim 8, wherein a through-hole through which the heater passes is formed at the partition of the first case and a lower portion of a vertical wall formed at both end portions of the first case.

10. The ice making machine of claim 7, wherein the heater is adhered to a surface of the first case by an adhesive sheet.

11. The ice making machine of claim 1, wherein a protrusion is formed at an outer surface of any one of the first case and the second case, and a groove into which the protrusion is inserted is formed at the remaining case.

12. The ice making machine of claim 1, wherein a concave-convex portion is formed at a part of a contact surface of the first case in contact with the second case.

* * * * *